United States Patent [19]

Valenti

[11] 4,411,217

[45] Oct. 25, 1983

[54] OVERRUNNING SYNCHRONIZABLE CLUTCH AND APPARATUS FOR TREATING WORK PIECES IN REGISTER WITH A PHYSICAL CHARACTERISTIC THEREOF

[75] Inventor: James P. Valenti, Lancaster, Pa.

[73] Assignee: Armstrong World Industries, Inc., Lancaster, Pa.

[21] Appl. No.: 366,241

[22] Filed: Apr. 8, 1982

[51] Int. Cl.[3] ..... B05C 1/02

[52] U.S. Cl. ..... 118/212; 118/239; 118/249; 192/113 A; 192/113 B; 192/41 A

[58] Field of Search ..... 101/183, 181; 192/113 R, 113 B, 113 A, 41 A, 43.1; 118/211, 212, 203, 249, 239, 210, 258

[56] References Cited

U.S. PATENT DOCUMENTS

| | | | |
|---|---|---|---|
| 1,472,614 | 10/1923 | Nitsch et al. | 118/203 X |
| 1,767,593 | 6/1930 | Laabs | 192/43.1 X |
| 2,909,258 | 10/1959 | Lacroix, Jr. | 192/113 B |
| 3,379,171 | 4/1968 | Cordingly et al. | 118/211 X |
| 3,400,789 | 9/1968 | Mione | 192/113 A X |

*Primary Examiner*—John P. McIntosh

[57] ABSTRACT

Disclosed is an apparatus for applying coating material to work pieces in register with a physical characteristic thereof as they are being moved through the apparatus. The apparatus includes an applicator roll, work moving means, and an overrunning clutch, all pre-set to operate in phase with each other when driven by a first drive through the clutch. When the first drive is inoperative, a second drive through the clutch continues rotation of the applicator roll through a supply of coating material. Subsequent reactivation of the first drive means moves the applicator roll in phase with the work moving means and the second drive stops.

6 Claims, 5 Drawing Figures

1
2
3
4
5
6
6a
6b
7
8
9
10
11
16
17
18
19
20
21
22
23
24
25
27
28
29
30
31
32
33
34
35
45
46
47
48
A
B
C
D
E
F
G
H
I
J
K
L

OVERRUNNING SYNCHRONIZABLE CLUTCH AND APPARATUS FOR TREATING WORK PIECES IN REGISTER WITH A PHYSICAL CHARACTERISTIC THEREOF

BACKGROUND OF THE INVENTION

1. Field of the Invention

This invention relates generally to an apparatus for treating work pieces in register with a physical characteristic thereof, and to a synchronizable, overrunning clutch usable therein. More specifically, this invention relates to an apparatus for applying a coating material to work pieces being moved through the apparatus wherein an applicator roll, work moving means, and an overrunning clutch are all pre-set to operate in phase with each other when a first or main drive is operative. When the main drive is inoperative, a second drive through the clutch rotates the applicator roll through a bath of the coating material. Subsequent reactivation of the first drive moves the applicator roll in phase with the work moving means and the second drive stops.

2. Description of the Prior Art

Overrunning or overriding clutches are not new and have long been used in connection with a variety of drive trains. Some examples are shown in U.S. Pat. No. 633,417 relating to a ratchet gear for bicycles, U.S. Pat. No. 3,233,471 relating to a power take off connection, and U.S. Pat. No. 4,049,099 relating to a motorcycle safety hub. It has also been known in the past to print or perform other operations on various materials and work pieces in register with some feature thereof by providing registration marks thereon which are detected by sensors which are operably connected to means for controlling the equipment being used to effect the desired registration of the work piece or material with the operation being performed thereon. One example of this is shown in U.S. Pat. No. 3,915,090 which relates to a printed pattern and embossed pattern registration control system.

The electronically operated registration control systems of the past were very expensive and very complicated, and while overrunning clutches are generally not new, the inventor is not aware of any such clutch capable of operating for a long period of time in a high temperature environment, and which may be mechanically preset and locked in synchronization with other components of the apparatus so that when the apparatus is stopped and then restarted, the registration capabilities are not affected. The inventor is further not aware of any other apparatus for applying a coating material to work pieces wherein, when the main drive system is inoperable the second drive through the clutch rotates the applicator roll in a bath of the material being applied, and wherein subsequent activation of the main drive mechanism causes the first drive to move the applicator roll in phase with the work moving means and the second drive stops.

SUMMARY OF THE INVENTION

This invention relates to an apparatus for treating work pieces in register with a physical characteristic thereof by applying a predetermined amount of coating material to work pieces as they are being conveyed beneath an applicator roll.

The apparatus comprises infeed and outfeed conveyors, an applicator roll and a back-up roll positioned therebetween, a synchronizable, overrunning clutch operably connected to the rolls and conveyors, all mechanically pre-set to operate in phase with each other when the outer housing of the clutch and the inner housing thereof are driven in unison by a main drive system.

The inner housing of the clutch is mounted on the applicator roll drive shaft and is driven by a separate drive system, when the main drive system is disengaged, so that the applicator roll is continuously rotating with its pattern-bearing outer surface passing through a supply of coating material. Means located between the inner and outer clutch housings to connect them when the main drive system is engaged, is overrun when the main drive system is disengaged and the inner housing of the clutch is being driven by its separate drive system. Since the outer housing of the clutch may be pre-set in synchronization with the work feeding means and the applicator roll, and locked in this position, the apparatus may be stopped and started repeatedly with perfect registration being maintained between the applicator roll and the work pieces being moved through the apparatus. Further, the inner housing of the clutch being driven by a separate drive means at a slower rate than that of the main drive system, keeps the applicator roll constantly rotating through the coating material supply. This eliminates the possibility of the coating material charring on the applicator roll and prevents leakage of the coating material at the point where it is supplied to the roll, which would normally occur because of the engraved design on the roll and the fact that the doctor blade of the supply container would not fit into the engraved portion of the pattern on the roll. Still further, means are provided for supplying a cooling lubricant to the clutch, and heat-dissipating means are provided on both the inner and outer housings thereof, thus enabling the clutch to operate for long periods of time in a high temperature environment.

It is an object of this invention to provide an apparatus capable of applying a predetermined amount of coating material, repeatedly, in the same predetermined location on each of a plurality of work pieces being moved through the apparatus;

It is a further object of the invention to provide such an apparatus which can accomplish the above and which may be mechanically pre-set;

It is a still further object of this invention to provide a clutch which can be pre-set and locked in synchronization with the movement of the applicator roll and the work moving means;

Another object of the invention is to provide a clutch through which the applicator roll can be kept turning at all times;

It is a further object of the invention to provide a clutch having heat dissipating features which enable it to be used in a high temperature environment;

It is another object of the invention to provide an apparatus which may be stopped and started without adversely affecting the registration of the pattern on the applicator roll with the location on the work piece where the adhesive is to be applied.

DESCRIPTION OF THE PREFERRED EMBODIMENT

Figures 1, 2:
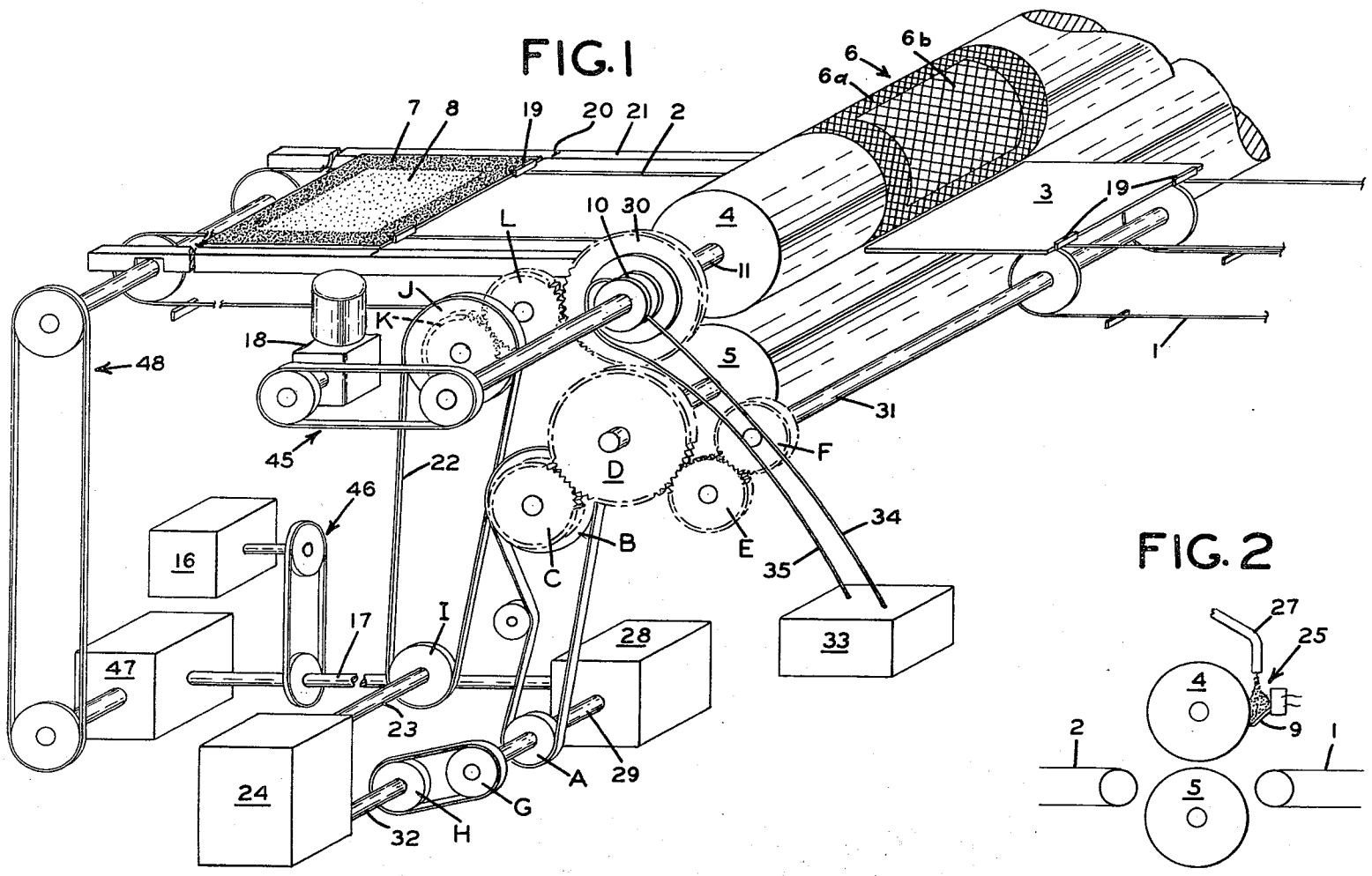
FIG. 1 is a diagrammatic illustration of the apparatus of this invention.
FIG. 2 is a diagrammatically illustrated side view showing the applicator and backup rolls, the adhesive supply means, and a portion of the work moving means of the apparatus of this invention.
Figure 3:
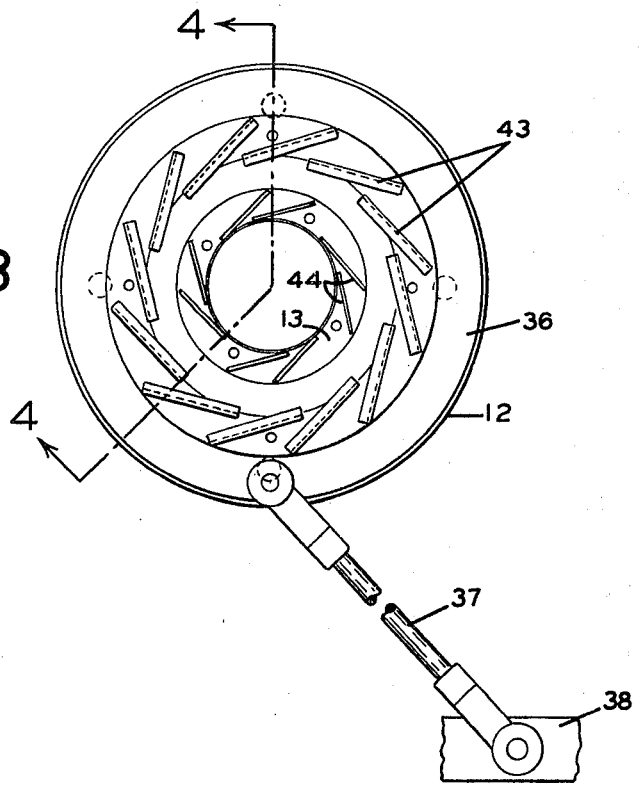
FIG. 3 is an end elevational view of the clutch of this invention.

Referring to the drawings, in FIG. 1 there is shown a diagrammatic illustration of the apparatus of this invention. The apparatus comprises infeed and outfeed conveyors 1 and 2 for moving the work pieces 3 through the apparatus. Vertically aligned work engaging rolls 4 and 5 are positioned between conveyors 1 and 2. The upper roll 4 is an applicator roll which is 23" in circumference and carries an engraved pattern 6 thereon similar in shape to that of a picture frame. The outer engraving 6*a* is cut to a depth of 14 mils and the 8"×8" inner pattern engraving 6*b* is cut to a depth of 10 mils. These depths of engraving relate to the fluid carrying capacity of the roll.

The purpose of the picture frame pattern 6 on the applicator roll 4 is to enable it to place adhesive on a work piece such as a tile passing through the apparatus, and to apply a minimum overall amount of adhesive to the tile work piece with the maximum amount of adhesive being applied by the outer quadrangular portion 6*a* of the engraved pattern 6, and thereby achieve a maximum edge bonding strength with a 25% reduction in the amount of adhesive that would normally be used in such an application.

The processing of the tile work pieces 3 by applying to the face thereof a 2" band of adhesive 7 with a less adhesive 8"×8" center portion 8 requires that the pattern must stay in register with the tile work piece 3. Also, in processing this material there is normally a number of start-ups and shut-downs. However, due to the engraved design 6 on the adhesive applicator roll 4, the roll must constantly turn or leakage will occur between the heated doctor blade 9 (see FIG. 2) and the engraved pattern 6 in the roll 4.

This problem is overcome by the following: The base machine which includes the infeed conveyor 1, the outfeed conveyor 2, the applicator roll 4 and the applicator backup roll 5 are completely timed and driven by a number of gears, timing belts, and the overrunning, set-position clutch 10 mounted on the drive shaft 11 of the applicator roll 4.

Figure 4:
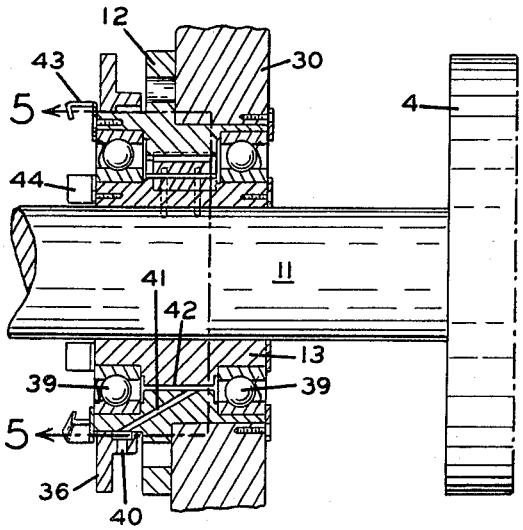
FIG. 4 is a cross-sectional view of the clutch of this invention taken along line 4—4 of FIG. 3.
Figure 5:
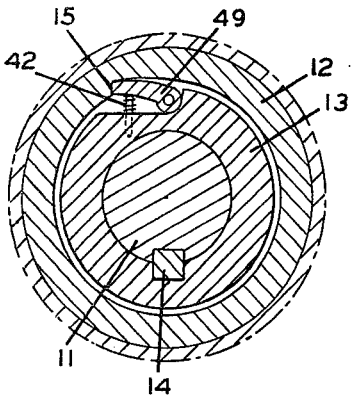
FIG. 5 is a cross-sectional view of the clutch of FIG. 3 taken along line 5—5 of FIG. 4.

The synchronizable overrunning clutch 10 mounted on the drive shaft 11 of the applicator roll as shown in FIGS. 4 and 5 has an outer housing 12 and an inner housing 13. The inner housing 13 of the clutch 10 being keyed to the drive shaft 11 as shown at 14 in FIG. 5 is rotated together with the applicator roll 4. As shown in FIG. 5, the inner housing 13 and the outer housing 12 of the clutch 10 are adapted to be operably connected by means of a latch 49 positioned on the inner housing 13 and a notch 15 on the inner circumference of the outer housing 12 when the outer housing 12 of the clutch 10 is being driven by a first drive means 16 through a belt and pulley arrangement 46 and drive shaft 17 as shown in FIG. 1. Latch 49 is biased toward the outer housing 12 by spring means 42 as shown in FIG. 5. When the first drive means 16 is inoperative, the applicator roll drive shaft 11 is separately driven by a second drive means 18 through a belt and pulley arrangement 45. The inner housing 13 of the clutch 10 rotates therewith and the latch 49 overruns the notch 15 in the outer housing 12 of the clutch 10. When the first drive 16 engages, the second drive 18 shuts off, going into a coast stop.

Referring to FIG. 1, the main body of the apparatus which includes the infeed and outfeed conveyors 1 and 2, the applicator roll 4, and the backup roll 5 therefor are completely timed and speed matched by the gearing drive system and the set-position clutch 10 used on the applicator roll drive shaft.

Still referring to FIG. 1 of the drawings, prior to running any product the apparatus is set up in the following manner: First, one of the conveying lugs 19 is lined up with a set-up mark 20 located on the outfeed conveyor rail 21. Second, the timing belt 22 connecting pulley I on the output shaft 23 of the variable power transmission unit 24 to pulley J is disconnected. The second drive means 18 must be shut off during this setup. Third, the outer housing 12 of the set-position clutch is rotated clockwise until the latch 49 on the inner housing 13 of the clutch 10 engages the notch 15 on the inner circumference of the outer housing 12 and the applicator roll 4 begins turning. Clockwise rotation is continued until the pattern 6 on the applicator roll 4 is phased with a work piece 3. Fourth, the timing belt 22 is then reinstalled, thus locking the entire drive system in phase together. Fifth, the second drive means 18 is turned on and adhesive is placed in the trough 25 through the adhesive fill line 27. It will be noted that once the adhesive is in place in the trough 25, the applicator roll 4 must not stop turning or the adhesive will leak between the pattern 6 of the roll 4 and the heated doctor blade 9.

At this point, the equipment is ready for processing and the following sequence takes place.

When the machine is started, the first drive 16 engages and the second drive 18 shuts off, going into a coast stop. The first drive 16 drives the outfeed conveyor 2 through the belt and pulley arrangement 46, drive shaft 17, right angle drive 47 and belt and pulley arrangement 48. Also driven by the first drive 16 are the infeed section 1 and the applicator backup roll 5, all of which are directly tied together through the following arrangement.

Drive shaft 17 driven by the first drive 16 drives the right angle drive 28 which in turn drives pulley A mounted on shaft 29. Pulley A drives pulley B, which is directly tied to gear C. Gear C drives gear D which turns the applicator backup roll 5 speed matched with the outfeed conveyor 2. Note that gear D is not connected to nor driving the outer portion of set-position clutch gear 30. Gear D also turns gear E. Gear E drives gear F which turns the head shaft 31 of the infeed conveyor 1. The right angle drive 28 also turns pulley G which drives the variable power transmission unit infeed shaft 32 through pulley H.

The unit 24 is required for surface speed matching the applicator roll 4. As the applicator rolls are reconditioned, the diameter of the roll becomes smaller due to regrinding. This changing diameter results in a slight change in surface speed which is compensated for by the variable power transmission unit 24.

The output shaft 23 of the unit 24 turns pulley I. Pulley I drives pulley J which is directly connected to gear K. Gear K drives gear L. Gear L turns the outer housing 12 of clutch 10 through clutch gear 30.

The outer housing 12 of clutch 10 is, at this point, turning at a higher rate of speed than the inner housing 13, and will now engage with the inner housing of clutch 10 by locking with the latch 49. The entire machine at this point is running in phase, and the applicator roll 4 is turning in phase with the base equipment, as determined by initial set-up.

At this point when the first drive 16 is stopped, all gearing, infeed conveyor 1, outfeed conveyor 2, the back-up roll 5 and outer portion 12 of clutch 10 stops. At this same instant, the second drive 18 is started and the applicator roll shaft 11 and the inner housing 13 of the clutch 10 will begin to turn clockwise within the locked outer portion 12.

Now, at the restart of the machinery, the inner housing 13 of the clutch 10 may be at any said location out of normal register with the rest of the machinery. However, when the first drive 16 is energized, the second drive 18 will go into a coast stop, and the notch 15 on the inner circumference of the outer housing 12 of the clutch 10 will engage latch 49 on the inner housing 13, placing the roll 4 instantaneously back in register.

In order to achieve this process of adhesive application, the temperature within the roll 4 which is heated by conventional means, is set at 600° F. As a result of the high temperature environment in which the clutch 10 must function, the clutch is designed with an oil cooling system for the purpose of dissipating heat from the bearings, as well as bearing lubrication.

For this purpose, an oil cooling supply unit 33 is provided which circulates oil through the clutch 10 by way of the oil lines 34 and 35 connected to the lubrication ring 36 (FIG. 4). The ring 36 is held fixed by a torque arm 37 fastened to a supply member 38. The oil is circulated to the bearings 39 through an opening 40 in the lubrication ring 36 and passageways 41 in the outer housing 12 and through the clearance 42 between the inner and outer housings 12 and 13 of the clutch 10. The oil is passed back to the supply unit 33 through line 35. This keeps the bearing below their temperature limit, 300° F., thus eliminating bearing seizure.

In addition to the oil cooling there are two fan means 43 and 44 mounted on the outer ends of the inner and outer housings 12 and 13, respectively. The purpose of these fans is to provide additional heat dissipation.

What is claimed is:

1. An apparatus for treating work pieces in register with a physical characteristic thereof, said work pieces being conveyed through said apparatus, comprising in combination:

(a) first and second conveying means for transporting the work pieces through said apparatus;

(b) means interposed between said first and second conveying means for treating the work pieces, comprising an upper rotary work piece-engaging member and a rotary back-up member therefor;

(c) first and second drive means for activating the conveying means and the work piece treating means operably connected by an overrunning, synchronizable clutch, for synchronizing the movement of said first and second conveying means and said work piece treating means, said clutch having (1) an outer housing disengagably operably connected to and synchronized with said first and second conveying means and the work piece treating means, and adapted to be driven by said first drive means, and (2) an inner housing operably connected to the upper rotary work piece-engaging member and adapted to be driven by said second drive means when said first drive means is inactivated, and (3) means interposed between said inner and outer housings of said clutch adapted to operably connect them when said first drive means is activated, whereby both clutch housings, the work piece treating means, and the first and second means for conveying the work pieces are then driven in unison by said first drive means.

2. An apparatus according to claim 1 wherein the upper rotary work piece-engaging member and the back-up member therefor comprise a pair of rolls, the upper roll having a predetermined engraved pattern on at least a portion of the surface thereof, said apparatus further including means for supplying a coating material to said engraved roll.

3. An apparatus according to claim 2 wherein said engraved pattern comprises a plurality of coating material-accepting pockets and includes an engraved inner portion substantially surrounded by an outer portion engraved to a greater depth than the inner portion and being adapted to carry and apply to a work piece engaged thereby more coating material than the inner portion of the pattern.

4. An apparatus according to claim 3 wherein said overrunning synchronizable clutch includes bearing means interposed between the inner and outer housings thereof, heat dissipating means positioned on both the inner and outer housings thereof and, means for supplying a lubricant to said bearings, said lubricant further functioning as a coolant for said clutch.

5. An apparatus according to claim 4 wherein an infinitely variable position power transmission means is interposed between the first drive means and the overrunning synchronizable clutch.

6. An apparatus for applying a predetermined amount of coating material to work pieces in register with a physical characteristic thereof, said work pieces being conveyed through said apparatus, comprising:

(a) first and second conveyors for conveying the work pieces through said apparatus, said conveyors having spaced means thereon to position the work pieces and also serve as a registration means when used in conjunction with registration marks on a portion of said apparatus adjacent said conveyors;

(b) a pair of vertically-aligned work-engaging rolls interposed between said first and second conveyors, the pair of rolls comprising an upper roll having an engraved pattern on at least a portion of the surface thereof, said pattern comprising an engraved inner portion substantially surrounded by an outer portion engraved to a greater depth than the inner portion;

(c) means for applying a coating material to said engraved roll;

(d) an overrunning, synchronizable clutch disengagably operably connected to the first and second conveyors and the pair of work piece-engaging rolls, said clutch comprising:

(1) an inner housing operably connected to the upper work piece-engaging roll;

(2) an outer housing operably connected to and synchronized with the first and second conveyors and to the pair of work piece-engaging rolls;

(3) a first drive means adapted to be operably connected to the outer housing of said clutch and thereby to the first and second conveyors and the work piece-engaging rolls;

(4) infinitely variable position power transmission means interposed between the first drive means and the overrunning synchronizable clutch;

(5) a second drive means adapted to be operably connected to the inner housing of said clutch and adapted to rotate the upper work piece-engaging roll when the first drive means is inactivated;

(6) means interposed between the inner and outer clutch housings to disengagably operably connect them when the outer housing is driven in one direction only;

(7) bearing means interposed between the inner and outer clutch housings;

(8) means for supplying a lubricant to said bearings, said lubricant further being adapted to function as a coolant for said clutch; and (9) heat-dissipating means positioned on both the inner and outer housings of said clutch.

* * * * *